United States Patent [19]

Ashok et al.

[11] Patent Number: 4,569,702

[45] Date of Patent: Feb. 11, 1986

[54] COPPER BASE ALLOY ADAPTED TO BE FORMED AS A SEMI-SOLID METAL SLURRY

[75] Inventors: Sankaranarayanan Ashok, Bethany; John F. Breedis, Trumbull, both of Conn.

[73] Assignee: Olin Corporation, New Haven, Conn.

[21] Appl. No.: 599,107

[22] Filed: Apr. 11, 1984

[51] Int. Cl.[4] ..... C22C 9/01

[52] U.S. Cl. ..... 148/414; 148/435; 148/436

[58] Field of Search ..... 148/414.1, 435, 436, 148/11.5 C, 12.7 C, 160; 420/486, 490; 164/900

[56] References Cited

U.S. PATENT DOCUMENTS

| | | | |
|---|---|---|---|
| 2,031,315 | 2/1936 | Jennison | 420/486 |
| 2,034,562 | 3/1936 | Davis et al. | 420/486 |
| 2,061,897 | 11/1936 | Crampton et al. | 148/433 |
| 2,074,604 | 3/1937 | Bolton et al. | 420/487 |
| 2,101,930 | 12/1937 | Davis et al. | 420/479 |
| 2,144,279 | 1/1939 | Whitman | 420/471 |
| 2,190,536 | 2/1940 | Staiger | 148/11.5 R |
| 2,236,975 | 4/1941 | Muller et al. | 420/522 |
| 2,430,419 | 11/1947 | Edens | 420/486 |
| 2,772,963 | 12/1956 | Pease et al. | 420/487 X |
| 2,789,900 | 4/1957 | Hannon | 420/486 |
| 2,851,353 | 9/1958 | Roach et al. | 420/486 |
| 3,364,016 | 1/1968 | Mikawa | 420/486 |
| 3,416,915 | 12/1968 | Mikawa | 420/486 |
| 3,635,702 | 1/1972 | Badia et al. | 420/422 |
| 3,902,544 | 9/1975 | Flemings et al. | 164/122 X |
| 3,936,298 | 2/1976 | Mehrabian et al. | 148/400 |
| 3,948,650 | 4/1976 | Flemings et al. | 75/10 R X |
| 3,951,651 | 4/1976 | Mehrabian et al. | 420/590 |
| 3,954,455 | 5/1976 | Flemings et al. | 148/400 |
| 4,073,667 | 2/1978 | Caron et al. | 148/12.7 C |
| 4,106,956 | 8/1978 | Bercovici | 148/11.5 A |
| 4,116,686 | 9/1978 | Mravic et al. | 148/11.5 C X |
| 4,401,488 | 8/1983 | Prinz et al. | 148/435 |
| 4,415,374 | 11/1983 | Young et al. | 148/2 |
| 4,494,461 | 1/1985 | Pryor et al. | 164/900 |

FOREIGN PATENT DOCUMENTS

| | | | |
|---|---|---|---|
| 2042385A | 9/1980 | United Kingdom . | |
| 2112676 | 7/1983 | United Kingdom | 148/11.5 C |
| 206097 | 12/1967 | U.S.S.R. | 420/486 |

OTHER PUBLICATIONS

"Rheocasting Processes" by Flemings et al., *AFS International Cast Metals Journal*, Sep., 1976, pp. 11–22.

"Die Casting Partially Solidified High Copper Content Alloys" by Fascetta et al., *AFS Cast Metals Research Journal*, Dec. 1973, pp. 167–171.

Alexander et al., *Journal of the Institute of Metals*, vol. 61, 1937, pp. 83–102, vol. 63, 1938, pp. 163–189 and vol. 64, 1939, pp. 217–230, Articles on "Copper-Rich Nickel Aluminum Copper Alloys".

*Primary Examiner*—Peter K. Skiff

*Attorney, Agent, or Firm*—Paul Weinstein; Howard M. Cohn; Barry L. Kelmachter

[57] ABSTRACT

A precipitation hardenable copper base alloy adapted for forming in the semi-solid slurry condition consists essentially of from about 5 to about 8% by weight nickel, from about 5 to about 7.5% by weight aluminum, from about 0.5 to about 1.25% by weight silicon and the balance essentially copper. The alloy has a microstructure comprising discrete particles contained in a lower melting point matrix. The alloy is particularly suited for forging into components such as cartridge cases.

11 Claims, 3 Drawing Figures

COPPER BASE ALLOY ADAPTED TO BE FORMED AS A SEMI-SOLID METAL SLURRY

The present invention relates to a copper base alloy which is adapted to be formed as a semi-solid metal slurry. The forming operation preferably comprises press forging. The alloy is precipitation hardenable in the forged state to provide desired levels of strength. The alloys of this invention find particular application in articles such as cartridge cases although they may be useful in a wide variety of articles.

In the manufacture of thin walled elongated high strength members such as cartridge cases, it is highly desirable to form the member from a material having physical properties capable of achieving certain desired objectives, i.e. sufficient fracture toughness to withstand the shock associated with firing, good formability so that the member can expand during firing and contract afterwards, high strength properties to form a reusable cartridge, etc.

In U.S. patent application Ser. No. 337,560 to Pryor et al. for a "Method And Apparatus For Forming A Thixoforged Copper Base Alloy Cartridge Casing" and assigned to the assignee of the present invention, there is disclosed a range of copper base alloys consisting essentially of from about 3% to about 20% nickel and from about 5% to about 10% aluminum and the remainder copper, which are adapted to be formed by forging a semi-solid metal slurry of the alloy. The formed part may be age hardened to provide high strength properties. Pryor et al. also disclose the application of the material and processing therein to the formation of thin walled members such as cartridge cases.

While the alloys of Pryor et al. have been found to be well suited to this application, it has now been found that the addition of silicon to a copper base alloy including nickel and aluminum within specific ranges provides an alloy having improved properties for forming as a semi-solid metal slurry. The addition of silicon lowers the melting point of the alloy while maintaining or increasing the temperature difference between its liquidus and solidus temperatures. Silicon also improves the aging kinetics of the alloy and reduces its quench sensitivity. Silicon also provides some improvement in conductivity.

It is known that alloys which are capable of forming a semi-solid metal slurry can have thixotropic properties which are beneficial in improving tool life and reducing thermal shock effects during processing. A metal or alloy composition which is suitable for forming while in the state of a semi-solid slurry having thixotropic properties generally has a microstructure comprising solid discrete particles in a surrounding matrix having a lower melting point than the particles. With such an alloy the surrounding matrix is solid when the metal composition is fully solidified and is liquid when the metal composition comprises a semi-solid slurry made up of the solid discrete particles in the molten surrounding matrix.

The microstructure of the copper base alloy may be formed by any of a number of techniques. One technique which is particularly preferred in accordance with the present invention involves casting the alloy while it is agitated or stirred, preferably by electromagnetic means. This technique which has sometimes been referred to as "rheocasting" or "thixocasting" is exemplified in U.S. Pat. Nos. 3,902,544, 3,948,650 and 3,954,455 all to Flemings et al., 3,936,298 and 3,951,651 both to Mehrabian et al., and 4,106,956 to Bercovici, U.K. Patent Application No. 2,042,385A to Winter et al. published Sept. 24, 1980 and the articles "Rheocasting Processes" by Flemings et al., *AFS International Cast Metals Journal,* September, 1976, pp. 11–22 and "Die Casting Partially Solidified High Copper Content Alloys" by Fascetta et al., *AFS Cast Metals Research Journal,* December, 1973, pp. 167–171. In this technique the solid discrete particles comprise degenerate dendrites or nodules which are generally spheroidal in shape.

An alternative technique for providing a copper base alloy or other metal or alloy with the desired microstructure suited to semi-solid metal forming is disclosed in U.S. Pat. No. 4,415,374 to Young et al. In this patent the alloy is prepared from a solid metal composition having a directional grain structure which is heated to a temperature between its solidus and liquidus to produce a partially solid, partially liquid mixture. The mixture is then solidified to provide the desired microstructure comprising discrete spheroidal particles contained within a lower melting matrix. Finally, certain alloys by the very nature of their composition form the desired microstructure when cast without stirring or agitation. This approach is exemplified in U.S. Pat. No. 4,116,686 to Mravic et al. wherein a phosphor-bronze is provided which possesses a substantially non-dendritic grain structure in the cast condition.

In the field of copper alloys, numerous patents exist covering alloys containing additions of nickel and aluminum and in some cases silicon. U.S. Pat. Nos. 2,031,315 to Jennison, 2,789,900 to Hannon, 2,851,353 to Roach et al., and German ALS No. 2,309,077 to Rozenberg et al. are particularly exemplary of such alloys. Jennison discloses a copper alloy which is characterized by the absence of "birch bark" as a result of heat treatment. The alloy comprises 0.1% to 1.5% silicon, 2.0% to 6% nickel, 0.5% to 6.5% aluminum and the balance copper. Iron in a range of 0.1% to 3% is optionally added to refine the grain size. There is no discussion in Jennison of the adaptability of his alloy to forming in a semi-solid metal state or that his alloy would achieve the desired slurry forming microstructure of the alloys of this invention. Hannon discloses a copper alloy containing approximately 3.5 to 5% nickel, 0.7 to 2% silicon, 3 to 10% aluminum and a critical iron content of 1.5 to 5%. Hannon's alloys may be hot forged. There is no discussion, however, in Hannon of forging the alloy in a semi-solid state or of forming a microstructure required for slurry formation as in accordance with this invention. Roach et al. disclose copper base alloys containing 5% to 15% nickel, 0.1% to 2% silicon and 0.1% to 6% aluminum or 0.1% to 2% magnesium, or both. Roach et al. also fail to disclose the adaptability of their alloys to forming in a semi-solid state and the provision of their alloys with a microstructure suited to such a forming technique. Rozenberg et al. claim an alloy including 10 to 12% nickel, 2.2 to 2.6% aluminum, 0.8 to 1.1% silicon and 0.5 to 0.8% chromium and the balance copper. Rozenberg et al.'s alloy has a low aluminum content but also is not disclosed to be suited to semi-solid metal forming or to be adapted to have a microstructure as in accordance with this invention.

In addition to the aforenoted patents, numerous other patents and publications exist relating to copper-nickel-aluminum "plus" alloys as, for example, those disclosed in U.S. Pat. Nos. 3,364,016 and 3,416,915 to Mikawa, 3,635,702 to Badia et al. and 4,073,667 to Caron et al. Of less interest are believed to be those alloys disclosed in U.S. Pat. Nos. 2,034,562, 2,061,897, 2,074,604, 2,101,930, 2,144,279, 2,236,975, 2,430,419, 2,772,963, 4,401,448 and Japanese Pat. No. 53-41096. A detailed investigation of copper-nickel-aluminum alloys is described in a series of articles by Alexander et al. appearing in the *Journal Of The Institute Of Metals* at Vol. 61, Pages 83 to 102, Vol. 63, Pages 163 to 189 and Vol. 64, Pages 217 to 230.

In accordance with the present invention, a precipitation hardenable copper base alloy has been found which is particularly suited to forming the desired microstructure and adapting it to semi-solid metal slurry forming processes. The alloy is adapted to have from about 10% to about 30% liquid phase during slurry forming. The alloy consists essentially of from about 5% to about 8% by weight nickel, from about 5% to about 7.5% by weight aluminum, from about 0.5 to about 1.25% by weight silicon and the balance essentially copper. The alloy has a microstructure comprising discrete particles contained in a matrix having a lower melting point than the particles. Preferably, the discrete particles comprise primary degenerate dendrites.

In accordance with a preferred aspect of the present invention, the alloy contains from about 5% to about 7% nickel, from about 5.5% to about 7% aluminum, from about 0.75% to about 1.2% silicon and the balance essentially copper. The alloys in accordance with this invention provide improved properties for semi-solid metal slurry forming techniques including having a lower melting point with an improved temperature differential between its liquidus and solidus. The alloys also provide improved aging kinetics, electrical conductivity and reduced quench sensitivity. Further, when the alloys have a microstructure in accordance with this invention comprising primary solid particles contained in a matrix having a lower melting point, they have surprising formability as compared to wrought alloys of similar composition.

Accordingly, it is an object of the present invention to provide an improved copper base alloy which is precipitation hardenable and which is adapted to be formed while it is in a semi-solid state.

It is a further object of this invention to provide such an alloy having a microstructure comprising solid particles contained in a matrix having a lower melting point than the particles.

It is a still further object of the present invention to provide an alloy as above in the forged and age hardened condition.

It is yet a further object of the present invention to provide a cartridge case formed from an alloy as above.

These and other objects will become more apparent from the following description and drawings.

Figure 1:
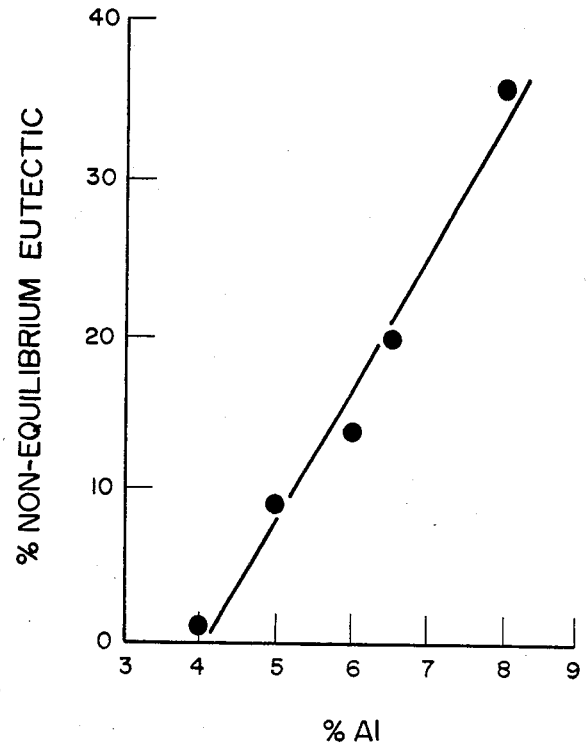
FIG. 1 is a graph showing the effect of silicon on the volume fraction of liquid in the resulting semi-solid metal slurry.

In accordance with this invention copper base alloys are provided which are adapted to be formed as a semi-solid slurry by techniques such as press forging. In the background of this application there has been briefly discussed techniques for forming semi-solid metal slurries by casting, forging, etc. Such slurries are often referred to as "thixotropic" since within certain ranges of volume fraction of liquid they behave in a thixotropic manner. Accordingly, sometimes forging of such slurries is referred to as "thixoforging" and casting of such slurries is referred to as "thixocasting". The preferred technique for forming the desired alloy microstructure in accordance with this invention comprises MHD slurry casting. Such a technique is sometimes referred to as "rheocasting".

The copper base alloy of the present invention is adapted to form a semi-solid slurry when heated to a temperature between its liquidus and solidus temperatures. The alloy preferably has a microstructure comprising discrete particles within a lower melting point matrix. If the alloy is formed by the preferred technique of MHD slurry casting in accordance with the teachings of Winter et al. as set forth in the British application noted in the background, then the discrete particles preferably comprise degenerate dendrites or nodules which are generally spheroidal in shape. These particles comprise primary solid particles and are made up of a single phase or a plurality of phases having an average composition different from the average composition of the generally surrounding matrix in the fully solidified alloy. The discrete particles are contained in a generally surrounding matrix which is solid when the alloy is fully solidified and which is liquid when the alloy has been heated to form a semi-solid slurry. The matrix itself comprises one or more phases having a lower melting point than the discrete particles.

Conventionally solidified alloys generally have branched dendrites which develop interconnected networks as the temperature is reduced and the weight fraction of solid increases. In contrast, semi-solid metal slurries formed by stirring consist of discrete primary degenerate dendrite particles separated from each other by a liquid metal matrix. The primary solid particles are degenerate dendrites in that they are characterized by smoother surfaces and a less branched structure than normal dendrites, approaching a spheroidal configuration. The surrounding solid matrix is formed during solidification of the liquid matrix subsequent to the formation of the primary solids and contains one or more phases of the type which would be obtained during solidification of the liquid alloy in a more conventional process. The surrounding matrix comprises dendrites, single or multi-phased compounds, solid solution, or mixtures of dendrites, and/or compounds, and/or solid solutions. In accordance with this invention the term "surrounding matrix" refers to the matrix in which the discrete particles are contained and it need not fully surround each particle. Therefore, the term "surrounding" should be read as generally surrounding.

Semi-solid slurries can be formed into a wide variety of possible shapes by techniques such as forging, die casting, etc. The semi-solid slurries in accordance with this invention by virtue of their structure comprising discrete particles in a molten matrix avoid problems relating to the separation of solids and liquids and thereby insure that uniform properties are obtained. The use of semi-solid slurries in press forging or die casting provides improved die life and reduced thermal shock effects during processing. In accordance with the present invention, it is possible to produce thin wall parts such as cartridge cases by press forging the alloy.

Alloys which are suited to forming in a semi-solid state must have particular combinations of properties not required for other processes such as die casting and conventional forging. For example, it is preferred that the alloys have a wide solidification range which comprises the temperature differential between the liquidus and solidus temperatures of the alloy. The alloy should preferably have from about 10% to about 30% of nonequilibrium eutectic phase so that the volume fraction of solid can be controlled upon heating the alloy to a semi-solid condition for forging. This range of volume fraction or percent of nonequilibrium eutectic phase corresponds to the range of volume percent liquid in the slurry upon heating to the semi-solid state. High fluidity of the molten alloy matrix is desired in order to minimize porosity in the finished part. Preferably, the alloy is precipitation hardenable in order to permit high strength to be attained without the necessity of cold working the resultant forged part. It is also desirable that the alloy exhibit a low quench sensitivity from the temperature at which it is solutionized before age hardening. Lower melting points for the alloy are desired to prolong die life. Improved electrical conductivity is desired to facilitate the use of magnetohydrodynamic (MHD) stirring to form the desired cast structure. Correspondingly improved thermal conductivity is advantageous for facilitating reheating to a uniform temperature before forging.

In the background of this application, a U.S. application to Pryor et al. has been described wherein certain copper-nickel-aluminum alloys have been formed into castings with a microstructure comprising discrete particles contained in a lower melting point matrix. Pryor et al. also disclose techniques for forming such alloys by forging into parts such as cartridge cases. In accordance with this invention it has been found that certain copper-nickel-aluminum-silicon alloys have particularly improved properties for providing a precipitation hardenable alloy with a microstructure comprising discrete particles in a lower melting point matrix adapted for press forging in a semi-solid slurry condition. In particular, it has surprisingly been found that silicon when added to a copper-nickel-aluminum alloy reduces the melting point of the alloy while maintaining or increasing the solidification temperature range of the alloy. It has also been surprisingly found that silicon improves the kinetics of age hardening of the alloy and reduces the quench sensitivity of the alloy from the solutionizing temperature. Further, silicon improves the conductivity of the alloy. It has also been surprisingly found that when an alloy in accordance with the present invention is put in a condition such that it has a microstructure comprising discrete particles in a matrix having a lower melting point then the elongation of the alloy is substantially improved as compared to the same alloy having a microstructure formed by conventional casting without stirring and hot working. Accordingly, the alloys of the present invention provide significant improvements in a number of properties important to semi-solid slurry forming techniques while maintaining comparable strength and formability of prior copper-nickel-aluminum alloys.

In accordance with this invention, a copper base alloy is provided having a microstructure comprising discrete particles contained within a matrix having a lower melting point than the particles. The alloys have a composition consisting essentially of from about 5% to about 8% by weight nickel, from about 5% to about 7.5% by weight aluminum, from about 0.5 to about 1.25% by weight silicon and the balance essentially copper. Preferably, the composition consists essentially of from about 5% to about 7% nickel, from about 5.5% to about 7% aluminum, from about 0.75% to about 1.2% silicon and the balance essentially copper.

The alloy as above having the above noted microstructure is preferably formed by MHD stirring techniques as described in Winter et al. U.K. and Pryor et al. U.S. patent applications although any desired technique as is known in the art could be employed for forming the alloy with the desired microstructure.

The alloy of the present invention having the desired microstructure can be formed in a semi-solid condition wherein the alloy has a volume fraction of about 10% to about 30% liquid comprising a molten metal matrix. This minimizes significant changes in the volume fraction liquid at the forging temperature as a function of small variations in temperature. It also provides better dimensional tolerance and improved die life. After forging the alloy of this invention is preferably subjected to a heat treatment to increase its strength comprising solutionizing followed by aging. It should be possible in accordance with this invention by virtue of the reduced quench sensitivity of the alloy to combine the solutionizing and forging treatments into one, namely it should be possible to obtain the desired solutionizing effect during the time the alloy is heated above its solutionizing temperature prior to and during forging. Alternatively, if desired, in accordance with this invention the forged alloy can be separately solution treated. Solutionizing in accordance with this invention preferably is carried out by heating the alloy to a temperature of at least about 800° C. for a time period of 5 minutes to 4 hours. Preferably, the alloy is heated to a temperature in the range of 800° C. to about 1000° C. for about 5 minutes to about 2 hours. After solutionizing the alloy is preferably quenched in water. If the solutionizing is carried out as part of the forging operation, then the alloy is preferably quenched immediately following forging.

After solutionizing the alloy is preferably subjected to an aging treatment wherein it is heated to a temperature in the range of from about 350° C. to about 700° C. for a time period of from about 1 minute to about 10 hours and, preferably, it is heated to a temperature of from about 400° C. to about 600° C. for about 5 minutes to about 3 hours.

When the alloys of the present invention are subjected to the aforenoted precipitation hardening treatment, they are capable of achieving a tensile strength of at least about 80 ksi.

Preferably, in accordance with this invention the alloys are formed into parts such as cartridge cases comprising thin walled elongated members. Preferably, the member has a cup-shaped configuration typical of a cartridge case. However, if desired, the alloy of the present invention can be utilized to form any desired component by the techniques which have been described.

It has previously been indicated that the volume fraction liquid when the alloy is heated to the semi-solid condition should be between about 10% to about 30%. This liquid comprises in the alloy of this invention a eutectic. The primary particles are believed to comprise an alpha ($\alpha$) phase solid solution including silicon. The matrix is believed to comprise a eutectic comprising alpha ($\alpha$) and beta ($\beta$) phases wherein the $\beta$ phase is likely to be an NiAl compound.

Referring now to FIG. 1, a graph is shown for an alloy having a nominal composition of 5.5% nickel and 0.75% silicon with varying aluminum contents. It is apparent from this graph that aluminum as well has a marked effect on the volume fraction of nonequilibrium eutectic or liquid during semi-solid forming. Accordingly, the range of aluminum in accordance with this invention has been limited to from about 5.0% to about 7.5%. It is believed that if the aluminum is below about 3% the alloy would contain all $\alpha$ phase.

Figure 2:
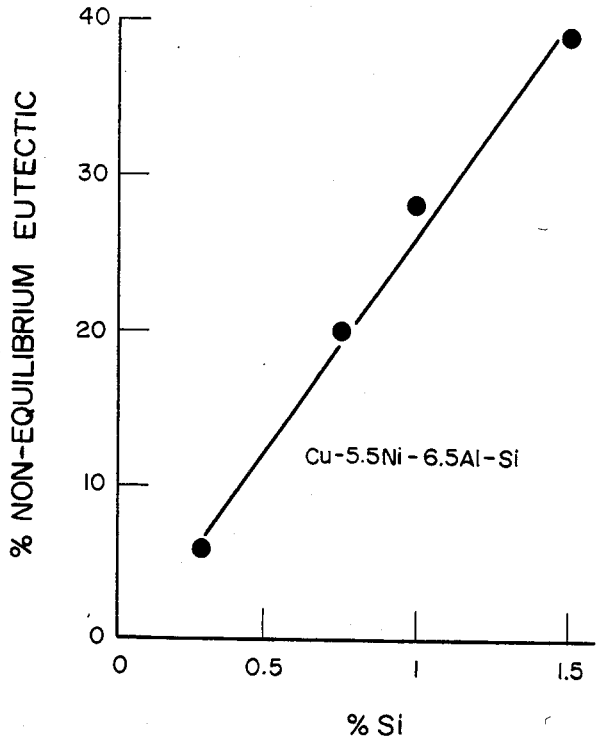
FIG. 2 is a graph showing the effect of aluminum on the volume fraction of liquid in the resulting semi-solid metal slurry.

Referring to FIG. 2, a series of alloys having a nominal composition comprising 5.5% nickel, 6.5% aluminum with varying silicon contents were examined metallographically to determine the percent of nonequilibrium eutectic phase present. It is apparent from a consideration of the figure that silicon has a marked effect on the volume fraction of eutectic which is equivalent to the expected volume fraction liquid during semi-solid slurry forming. Accordingly, the silicon range in accordance with the present invention has been limited to an amount between about 0.5% to about 1.25%.

The effect of increasing silicon content on the solidification range of the alloys of this invention is shown in Table I.

TABLE I

EFFECT OF Si CONTENT ON MELTING RANGE OF Cu—Ni—Al BASE ALLOYS

| | Weight Percent | | | Melting Point (°C.) | | |
|---|---|---|---|---|---|---|
| Alloy | Ni | Al | Si | $T_L$ | $T_S$ | $\Delta T$ |
| 1 | 10 | 7.5 | 0 | 1085 | 1065 | 20 |
| 2 | 5 | 7 | 0 | 1073 | 1042 | 31 |
| 3 | 5 | 7 | 0.5 | 1056 | 1010 | 46 |
| 4 | 5 | 7 | 1.0 | 1040 | 1008 | 32 |
| 5 | 5 | 7 | 1.5 | 1018 | 996 | 22 |

Alloys having the nominal composition set forth in Table I were chill cast into 1 pound castings ½" thick and then reheated to determine their liquidus temperature ($T_L$), solidus temperature ($T_S$) and solidification temperature range ($\Delta T$). Alloy 1 comprises the preferred composition of the Pryor et al. U.S. application. Alloy 2 comprises an alloy having nickel and aluminum within the ranges of the present invention but no silicon. Alloys 3 and 4 comprise alloys of the present invention. Alloy 5 comprises an alloy having silicon in excess of the present invention.

It is apparent from a consideraiton of the results set forth in Table I that the addition of silicon reduces the melting point of the resultant alloy and, further, that silicon within the ranges of this invention maintains or increases the solidification temperature range, i.e. silicon below 1% increases the solidification temperature range. Silicon was also found to increase liquid metal fluidity.

Referring now to Table II the effect of silicon on the aging kinetics of the alloy will be illustrated.

TABLE II

PEAK AGED HARDNESS OF Cu—Ni—Al BASE ALLOYS

| | Weight Percent | | | Vickers | Aging Time (hrs.) |
|---|---|---|---|---|---|
| Alloy | Ni | Al | Si | Hardness | at 550°.C. |
| 1 | 10 | 7.5 | 0 | 230 | 6 |
| 2 | 5 | 7 | 0 | 160 | 24 |
| 3 | 5 | 7 | 0.3 | 206 | 16 |
| 4 | 5 | 7 | 0.5 | 220 | 1 |
| 5 | 5 | 7 | 1 | 225 | 1 |
| 6 | 5 | 7 | 1.5 | 230 | 1 |

TABLE II-continued

PEAK AGED HARDNESS OF Cu—Ni—Al BASE ALLOYS

| | Weight Percent | | | Vickers | Aging Time (hrs.) |
|---|---|---|---|---|---|
| Alloy | Ni | Al | Si | Hardness | at 550° C. |
| 7 | 5 | 6 | 1 | 232 | 1 |
| 8 | 5 | 8 | 1 | 235 | 1 |
| 9 | 4 | 7 | 0.3 | 185 | 16 |
| 10 | 4 | 7 | 1 | 190 | 6 |
| 11 | 6 | 7 | 0.3 | 287 | 6 |
| 12 | 6 | 7 | 1 | 256 | 1 |

Alloys having the nominal compositions set forth in Table II were chill cast ½" thick as 1 pound castings. The castings were soaked at 950° C. for 2 hours and then hot rolled at 950° C. to a 50% reduction in two to three passes so that the resulting material was ½" thick. Samples of the alloy were then solution treated at 950° C. for 1 hour and water quenched and then aged until they reached peak hardness at 550° C. The hardness results clearly indicate that Alloys 4, 5, 7 and 8 in accordance with the present invention achieve a hardness comparable to the copper-nickel-aluminum alloys of the prior art. However, the kinetics of the precipitation hardening which are indicated by the aging time required to achieve peak hardness, as shown in the last column, are substantially improved by the addition of silicon. Table II also illustrated by a consideration of Alloys 9 and 10 that the nickel content in accordance with the present invention should be above 5% in order to achieve the desired strength. Further, it is apparent from a comparison of Alloys 9 through 12 that nickel coacts with silicon within the ranges of this invention to provide the improved aging kinetics.

Referring now to Table III, the wrought tensile properties of selected alloys from Table II are set forth.

TABLE III

PEAK AGED TENSILE PROPERTIES OF Cu—Ni—Al BASE ALLOYS

| | Weight Percent | | | UTS | Elong | Vickers |
|---|---|---|---|---|---|---|
| Alloy | Ni | Al | Si | (ksi) | (%) | Hardness |
| 1 | 10 | 7.5 | 0 | 98 | 20 | 230 |
| 5 | 5 | 7 | 1 | 109 | 11 | 225 |
| 7 | 5 | 6 | 1 | 101 | 8.0 | 232 |
| 4 | 5 | 7 | 0.5 | 96 | 7.0 | 220 |

It is apparent from a consideration of Table III that the alloys of the present invention are able to achieve the desired strength and hardness of the copper-nickel-aluminum alloys of the prior art. However, the elongation of the alloys of the present invention is substantially reduced. The alloys which have been tested in Tables I—III have been formed by conventional casting without the desired microstructure required in accordance with this invention. It is believed, however, that the strength achieved by these alloys is representative of MHD cast and press forged alloys in accordance with this invention.

In order to verify this belief an additional test was run whose results are set forth in Table IV.

TABLE IV

| Alloy No. 1 | | Condition | UTS (ksi) | % Elong in 0.5" |
|---|---|---|---|---|
| 1 | Cu-9.91Ni-7.23Al | As Cast | 66 | 60 |
| 2 | Cu-8.06Ni-7.82Al | As Cast | 67 | 80 |
| 3 | Cu-7.00Ni-7.19Al | As Cast | 61 | 66 |

TABLE IV-continued

| Alloy No. 1 | | Condition | UTS (ksi) | % Elong in 0.5" |
|---|---|---|---|---|
| 4 | Cu-5.52Ni-6.36Al-0.88Si | As Cast | 67 | 63 |
| 1 | Cu-9.91Ni-7.23A. | Aged | 105 | 20 |
| 2 | Cu-8.06Ni-7.82Al | Aged | 107 | 21 |
| 3 | Cu-7.00Ni-7.19Al | Aged | 106 | 10 |
| 4 | Cu-5.52Ni-6.36Al-0.88Si | Aged | 95 | 20 |

Alloys having the compositions set forth in the table were MHD cast by the Winter et al. technique and aged at 550° C. to peak hardness. The results show surprisingly that the strength levels achieved by the MHD cast and aged Alloy 4 of this invention are comparable to that of the conventionally cast material of Tables I through III, however, the elongation is substantially improved to a level comparable to MHD cast copper-nickel-aluminum alloys per se.

Figure 3:
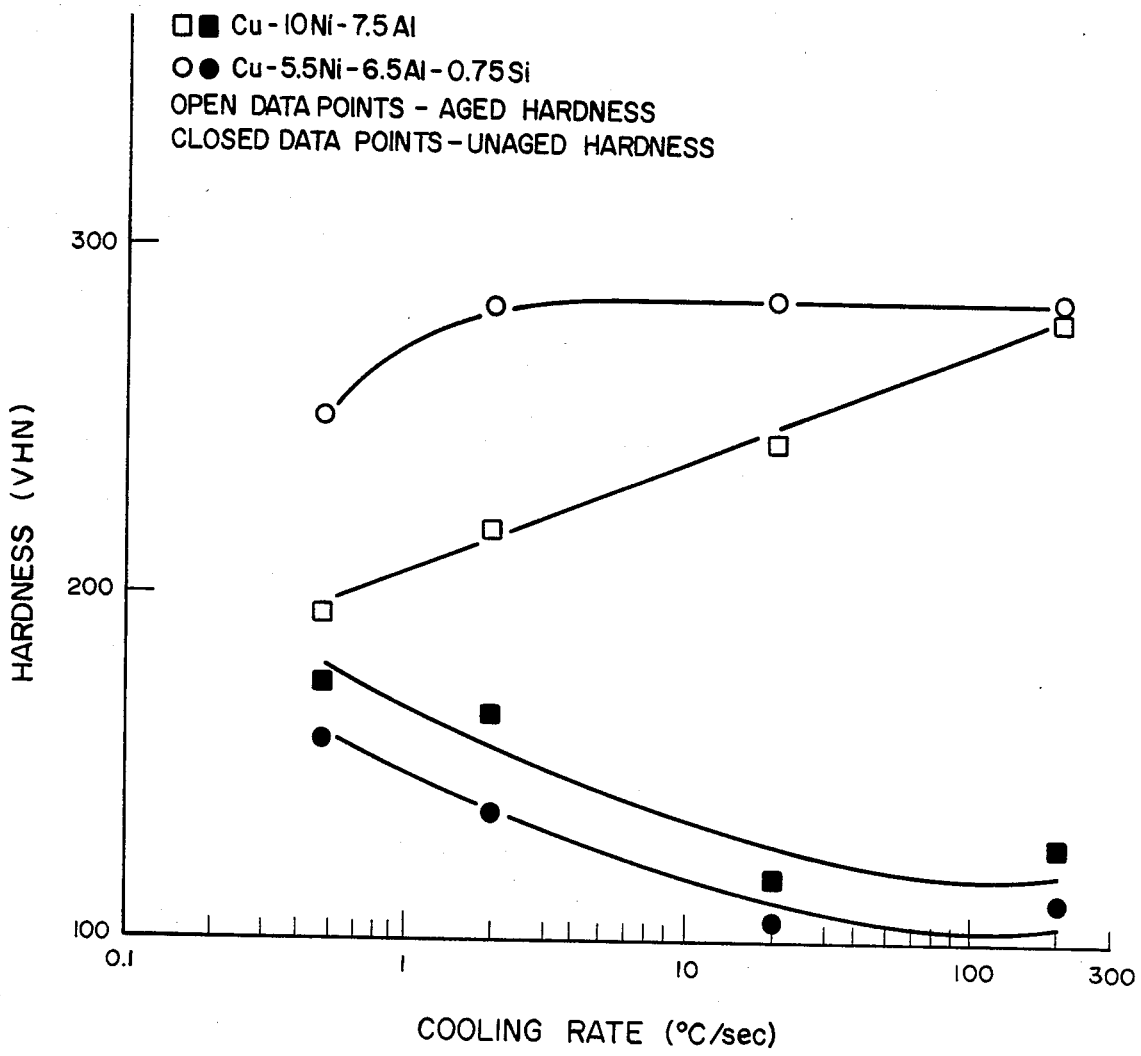
FIG. 3 is a graph showing the effect of silicon on quench sensitivity of copper-nickel-aluminum alloys.

Referring now to FIG. 3, the effect of silicon on the quench sensitivity of copper-nickel-aluminum alloys is illustrated. The alloys which were tested as set forth in FIG. 3 comprised MHD cast samples having the nominal compositions of Cu—10%Ni—7.5%Al and Cu—5.5%Ni—6.5%Al—0.77%Si. The alloys after casting were reheated to 950° C. at which temperature they were held for 1 hour. The alloys were then cooled to room temperature at rates varying between 200° and 0.5° C. per second. The hardness of these samples immediately after cooling and after subsequent aging to peak hardness at 550° C. are depicted in FIG. 3. The silicon containing alloy exhibits lower hardness immediately after cooling from the 950° C. temperature as compared to the ternary composition. Surprisingly the aged properties of the silicon containing alloy are unaffected by differences in cooling rates to as slow as 2° C. per second; whereas, the comparable hardness of the ternary alloy is significantly reduced for slower cooling rates. This is a significant improvement since the reduced quench sensitivity of the alloys of this invention make them more amenable to aging after forging without the necessity of a separate solutionizing treatment.

A comparison of the conductivities of the alloys of this invention and the ternary alloys of the prior art are summarized in Table V.

TABLE V

ELECTRICAL AND THERMAL CONDUCTIVITIES OF Cu—Ni—Al BASE ALLOYS

| | Cu-10Ni-7.5Al | Cu-5.5Ni-6.5Al-0.75Si |
|---|---|---|
| Measured Electrical Conductivity (% IACS) | 7 | 10 |
| Calculated Thermal Conductivity (BTU/ft$^2$/hr/°F.) | | |
| Solid | 20 | 28 |
| Liquid | 10 | 14 |

The electrical conductivities were determined for samples of alloys having the nominal compositions set forth in the table in the MHD cast condition. The thermal conductivities were calculated from the determinations of electrical conductivities of the alloys in the MHD cast condition and assuming the same proportionality between liquid and solid as found for pure copper. The results show that the alloys of this invention have approximately 40% higher conductivity than the prior art ternary alloys. This makes the alloys more favorable for MHD casting and press forging as previously described.

It has been found that silicon should be limited to below about 1.5% since the Cu—5%Ni—7%Al—1.5%Si alloy listed in Table II exhibited nil ductility and could not be cold rolled. Similarly, an alloy containing Cu—5%Ni—8%Al—1%Si was too brittle to cold roll and, therefore, aluminum should be limited to below 8%.

Based on the above, the nickel content should be at least 5% in order to achieve adequate strength and improved precipitation kinetics. The nickel content should be less than 8% in order to maintain adequate ductility. The aluminum content should preferably be at least 5% in order to have a desired volume fraction of liquid in the semi-solid slurry. The upper limit of aluminum should not exceed 7.5% so that the alloy will not become brittle. At least about 0.5% silicon should be present in order to provide adequate strength and the other improvements associated with silicon. The upper limit for silicon should not exceed about 1.25% by virtue of considerations of the volume fraction of liquid in the semi-solid slurry and the brittleness of the resultant alloy.

The patents, patent applications, and articles set forth in this specification are intended to be incorporated by reference herein.

The term "ksi" as used herein comprises thousands of pounds per square inch. "UTS" stands for ultimate tensile strength.

It is apparent that there has been provided in accordance with this invention a copper base alloy adapted to be formed as a semi-solid metal slurry which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A precipitation hardenable copper base alloy having a structure comprising discrete particles contained in a matrix having a lower melting point than said particles, said particles and said matrix being comprised such that when said alloy is heated to a desired temperature said alloy forms a semi-solid slurry wherein said matrix is in a molten condition comprising from about 10% to about 30% liquid and said particles are within said liquid matrix, said alloy consisting essentially of from about 5 to about 8% by weight nickel, from about 5 to about 7.5% by weight aluminum, from about 0.5 to about 1.25% by weight silicon and the balance essentially copper.

2. An alloy as in claim 1 wherein said copper base alloy consists essentially of from about 5 to about 7% nickel, from about 5.5 to about 7% aluminum, from about 0.75 to about 1.2% silicon and the balance essentially copper, said alloy having improved age hardening kinetics and reduced quench sensitivity.

3. An alloy as in claim 1 which is in a thixoforged condition.

4. An alloy as in claim 3 which is in an aged condition.

5. An alloy as in claim 3 which is in a solution treated and aged condition.

6. An alloy as in claim 1 which comprises a cartridge case comprising an elongated thin walled member.

7. An alloy as in claim 4 which comprises a cartridge case comprising an elongated thin walled member.

8. An alloy as in claim 5 which comprises a cartridge case comprising an elongated thin walled member.

9. An alloy as in claim 1 wherein said particles comprise primary degenerate dendrites.

10. An alloy as in claim 1 wherein said particles comprise an alpha phase and wherein said matrix comprises a eutectic having alpha and beta phases.

11. An alloy as in cliam 10 wherein said beta phase comprises NiAl.

* * * * *